US011690404B2

(12) United States Patent
Chen

(10) Patent No.: US 11,690,404 B2
(45) **Date of Patent: *Jul. 4, 2023**

(54) E-LIQUID BOTTLE AND ELECTRONIC CIGARETTE

(71) Applicant: SHENZHEN SMOORE TECHNOLOGY LIMITED, Shenzhen (CN)

(72) Inventor: Zhiping Chen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 341 days.

This patent is subject to a terminal disclaimer.

(21) Appl. No.: 17/119,154

(22) Filed: Dec. 11, 2020

(65) Prior Publication Data

US 2021/0093004 A1 Apr. 1, 2021

Related U.S. Application Data

(63) Continuation of application No. 15/768,016, filed as application No. PCT/CN2016/088794 on Jul. 6, 2016, now Pat. No. 10,893,703.

(30) Foreign Application Priority Data

Oct. 28, 2015 (CN) ..... 201510716898.7

(51) Int. Cl.
*A24F 47/00* (2020.01)
*A24F 40/485* (2020.01)
(Continued)

(52) U.S. Cl.
CPC ..... *A24F 40/485* (2020.01); *A24F 40/42* (2020.01); *A24F 47/00* (2013.01); *B65D 47/06* (2013.01);
(Continued)

(58) Field of Classification Search
CPC ..... A24F 40/48; A24F 40/485
See application file for complete search history.

(56) References Cited

U.S. PATENT DOCUMENTS 5,348,194 A 9/1994 Mascitelli et al.
6,234,363 B1 5/2001 Stradella
(Continued)

FOREIGN PATENT DOCUMENTS

CN 102264250 A 11/2011
CN 202499368 U 10/2012
(Continued)

OTHER PUBLICATIONS

The first office action with translation of CN application No. 201510716898.7 dated Jun. 26, 2017.
(Continued)

*Primary Examiner* — Eric Yaary
(74) *Attorney, Agent, or Firm* — Andrew C. Cheng

(57) ABSTRACT

The present disclosure provides an e-liquid bottle engageable with an electronic cigarette. The e-liquid bottle includes a main body (11), a cover (12), and a control switch (14); the cover (12) forms at least one liquid outlet (121); the control switch (14) is arranged in the cover (12). The electronic cigarette includes a cartridge (21) and a liquid injection device (23); the cartridge (21) forms a liquid reservoir (A), and one end of the cartridge (21) comprises an end wall (223) and a second operation portion (222) extending axially outwards from the end wall (223); the end wall (223) forms one liquid injection opening (2231), the second operation portion (222) corresponds to the control switch (14); the liquid injection device (23) is arranged on the end of the cartridge (21) and forms a liquid injection channel, and a first liquid inlet (2321) is formed in the liquid injection channel.

18 Claims, 12 Drawing Sheets

(51) Int. Cl.

| | |
|---|---|
| ***B67C 3/26*** | (2006.01) |
| ***A24F 40/42*** | (2020.01) |
| ***B65D 47/06*** | (2006.01) |
| ***B65D 50/04*** | (2006.01) |
| *A24F 40/10* | (2020.01) |
| *A24F 15/015* | (2020.01) |

(52) U.S. Cl.
CPC ..... *B65D 50/04* (2013.01); *B67C 3/2637* (2013.01); *A24F 15/015* (2020.01); *A24F 40/10* (2020.01)

(56) References Cited

U.S. PATENT DOCUMENTS

| | | | | |
|---|---|---|---|---|
| 2010/0200008 | A1 | 8/2010 | Taieb | |
| 2011/0315152 | A1* | 12/2011 | Hearn | A61M 15/0093 131/273 |
| 2014/0109921 | A1 | 4/2014 | Chen | |
| 2014/0283946 | A1 | 9/2014 | Kribs | |
| 2015/0059787 | A1 | 3/2015 | Qiu | |
| 2015/0150306 | A1 | 6/2015 | Chen | |
| 2015/0245662 | A1 | 9/2015 | Memari et al. | |
| 2015/0257449 | A1 | 9/2015 | Gabbay | |
| 2015/0282530 | A1 | 10/2015 | Johnson et al. | |
| 2016/0000147 | A1 | 1/2016 | Li et al. | |
| 2016/0100633 | A1 | 4/2016 | Gao | |
| 2017/0105453 | A1 | 4/2017 | Li et al. | |
| 2017/0347705 | A1 | 12/2017 | Li | |
| 2017/0359858 | A1 | 12/2017 | Liu | |
| 2018/0014577 | A1 | 1/2018 | Qiu | |
| 2018/0064172 | A1 | 3/2018 | Qiu | |

FOREIGN PATENT DOCUMENTS

| | | | |
|---|---|---|---|
| CN | 202760867 | U | 3/2013 |
| CN | 202828406 | U | 3/2013 |
| CN | 202863984 | U | 4/2013 |
| CN | 203105624 | U | 8/2013 |
| CN | 103462224 | A | 12/2013 |
| CN | 103818629 | A | 5/2014 |
| CN | 104135881 | A | 11/2014 |
| CN | 204104822 | U | 1/2015 |
| CN | 105192896 | A | 3/2015 |
| CN | 204351070 | U | 5/2015 |
| CN | 104720114 | A | 6/2015 |
| CN | 204377940 | U | 6/2015 |
| CN | 204393354 | U | 6/2015 |
| CN | 204560962 | U | 8/2015 |
| CN | 204560974 | U | 8/2015 |
| CN | 204670386 | U | 9/2015 |
| CN | 204697897 | U | 10/2015 |
| CN | 204742640 | U | 11/2015 |
| CN | 105192895 | A | 12/2015 |
| CN | 105212270 | A | 1/2016 |
| CN | 105212278 | A | 1/2016 |
| CN | 105231492 | A | 1/2016 |
| CN | 205125041 | U | 4/2016 |
| CN | 205143486 | U | 4/2016 |
| CN | 105595436 | A | 5/2016 |
| CN | 205196994 | U | 5/2016 |
| CN | 205196995 | U | 5/2016 |
| CN | 205337596 | U | 6/2016 |
| CN | 205358217 | U | 7/2016 |
| CN | 105962420 | A | 9/2016 |
| CN | 205648912 | U | 10/2016 |
| CN | 205848691 | U | 1/2017 |
| DE | 202012005406 | U1 | 8/2012 |
| WO | 2010073018 | A1 | 7/2010 |
| WO | 2013110211 | A1 | 8/2013 |

OTHER PUBLICATIONS

Search report with translation of CN application No. 201510716898.7 dated Jun. 26, 2017.
The second office action with translation of CN application No. 201510716898.7 dated Mar. 7, 2018.
Search report with translation of CN application No. 201510716898.7 dated Mar. 7, 2018.
The third office action and search report with translation of CN application No. 201510716898.7 dated Apr. 28, 2018.
Non-Final Rejection of U.S. Appl. No. 15/768,016 dated Feb. 4, 2020.
Communication pursuant to Rules 70(2) and 70a(2) EPC of EP application No. 16858736.8 dated Oct. 26, 2018.
The extended European search report of EP application No. 16858736.8 dated Oct. 9, 2018.
International Search Report with translation of PCT Patent Application No. PCT/CN2016/088794 dated Aug. 31, 2016.
Written opinion of the international searching authority with translation of PCT Patent Application No. PCT/CN2016/088794 dated Aug. 31, 2016.
The first office action and search report with translation of CN application No. 201610485061.0 dated Apr. 20, 2018.
The second office action and search report with translation of CN application No. 201610485061.0 dated Nov. 16, 2018.
The third office action and search report with translation of CN application No. 201610485061.0 dated Apr. 20, 2019.
The fourth office action and search report with translation of CN application No. 201610485061.0 dated Sep. 17, 2019.
Non-Final Rejection of U.S. Appl. No. 15/314,514 dated Jun. 8, 2018.
The extended European search report of EP application No. 16847605.9 dated May 14, 2018.
Communication pursuant to Rules 70(2) and 70a(2) EPC of EP application No. 16847605.9 dated Jan. 6, 2018.
Communication pursuant to Article 93(3) EPC of EP application No. 16847605.9 dated Feb. 8, 2021.
Notice of Allowance of U.S. Appl. No. 15/314,514 dated Oct. 19, 2018.
International Search Report of PCT Patent Application No. PCT/CN2016/087418 dated Mar. 1, 2017.
Written Opinion of PCT Patent Application No. PCT/CN2016/087418 dated Mar. 1, 2017.
Search Report of CN application No. 2015107166110 dated Jun. 23, 2017.
Search Report of CN application No. 2015107166110 dated Feb. 11, 2018.
First Office Action of CN application No. 2015107166110 dated Jun. 23, 2017.
Second Office Action of CN application No. 2015107166110 dated Feb. 11, 2018.

* cited by examiner

E-LIQUID BOTTLE AND ELECTRONIC CIGARETTE

TECHNICAL FIELD

The present disclosure relates to substitutes for tobacco cigarettes, and more particularly, to an e-liquid bottle and an electronic cigarette.

BACKGROUND

At present, electronic cigarettes, also known as virtual cigarettes or electronic atomizers are often used as substitutes for tobacco cigarettes. Electronic cigarettes look and smell like tobacco cigarettes, but is free of harmful gradients like tar and suspended particles.

An electronic cigarette typically includes a liquid reservoir, an atomizer arranged at one end of the liquid reservoir, and a mouthpiece arranged at the other end of the liquid reservoir. When e-liquid in the liquid reservoir is used up, the e-liquid is injected into the liquid reservoir after the mouthpiece is opened. The structure of the mouthpiece is easy to remove, and children may easily open the mouthpiece to contact and further drink the e-liquid by mistake.

In addition, it may be easy for children to open the present e-liquid bottle and contact the e-liquid.

Technical Problem

The technical problem solved by the present disclosure is to provide an improved e-liquid bottle and an electronic cigarette.

SUMMARY OF THE DISCLOSURE

The present disclosure provides an e-liquid bottle. The e-liquid bottle includes a main body, a cover, and a control switch; the cover forming at least one liquid outlet; the control switch being arranged in the cover for controlling opening and closing of the liquid outlet; the liquid outlet being opened when the control switch is pressed inwards and being sealed when the control switch is released.

In an embodiment, the control switch includes a button switch, a liquid stopper, and a first restoring member; the button switch is axially movably arranged on the cover; the liquid stopper is located on an inner side of the cover and is connected to the button switch and seals an inner end of the liquid outlet; the first restoring member provides a force such that the button switch restores to its original state and the liquid stopper seals the liquid outlet.

In an embodiment, the liquid stopper is a gasket, the control switch further includes a supporting member connected to an inner end of the button switch, and the supporting member includes a supporting board on which the liquid stopper is mounted.

In an embodiment, the gasket and the supporting board are annular, the supporting board defines a fixing hole in which the liquid stopper is mounted, and a fixing column being inserted into the fixing hole is arranged on the gasket.

In an embodiment, the e-liquid bottle includes a first operation portion for pressing a liquid injection device of an electronic cigarette such that the liquid injection device can inject e-liquid to the electronic cigarette.

In an embodiment, the first operation portion is the cover.

In an embodiment, the e-liquid bottle further includes a liquid-out tube arranged inside the liquid outlet and extending outwards from the liquid outlet.

The present disclosure further provides an electronic cigarette engageable with the above e-liquid bottle; the electronic cigarette includes a cartridge and a liquid injection device;

the cartridge forms a liquid reservoir, and one end of the cartridge includes an end wall and a second operation portion extending axially outwards from the end wall;

the end wall forms at least one liquid injection opening, the second operation portion corresponds to the control switch such that the control switch can be pressed by the second operation portion;

the liquid injection device is arranged on the end of the cartridge corresponding to the end wall for being pressed by the e-liquid bottle, the liquid injection device forms a liquid injection channel corresponding to the liquid outlet and the liquid injection opening respectively, and a first liquid inlet is formed in the liquid injection channel;

When the liquid injection device is pressed inwards by the e-liquid bottle, the liquid injection channel moves inwards to communicate the liquid injection opening with the liquid reservoir, and the second operation portion presses the control switch to communicate the liquid outlet with the liquid injection channel; when the e-liquid bottle is removed, the liquid injection channel restores to its original position to block the first liquid inlet from the liquid reservoir.

In an embodiment, the liquid injection device includes an abutting member for being pressed inwards by the e-liquid bottle and a liquid injection tube arranged on the abutting member; and the abutting member defines an insertion hole, the liquid injection tube is inserted in the insertion hole, and the liquid injection tube forms the liquid injection channel.

In an embodiment, the liquid injection tube extends into the liquid injection opening, an outer wall of the liquid injection tube engages with the liquid injection opening tightly, and a blocker is arranged in an inner hole of the liquid injection tube to block the liquid reservoir from the first liquid inlet.

In an embodiment, a sealing ring is arranged between an outer wall of an inner end of the liquid injection tube and the liquid injection opening.

In an embodiment, the abutting member is spaced from the end wall and is movable forwards and backwards to get closed to or away from the end wall.

In an embodiment, the liquid injection device further includes a second restoring member providing a force to keep the abutting member away from the end wall and to keep the first liquid inlet out of the end wall.

In an embodiment, the liquid injection tube is shaped as a stepped tube including a first section and a second section, a diameter of the first section is greater than that of the second section, the first section is inserted into the abutting member, and the second section is inserted into the liquid injection opening; a step is formed on an outer wall of the first section at the connection between the first section and the second section to restrict a movement of the liquid injection tube inside the liquid injection opening; and an inner hole of the second section is smaller than that of the first section.

In an embodiment, the second operation portion is shaped as a tube located on an axis of the cartridge; and the abutting member is annular and is axially movably sleeved on the second operation portion.

In an embodiment, a tubular sleeving portion is arranged on an outer circle of the end wall, and the sleeving portion extends away from the liquid reservoir; a connection portion is arranged on an inner circle of one end of the sleeving portion away from the end wall, and the abutting member abuts an inner side of the connection portion.

In an embodiment, an inner circle of the connection portion is configured with threads engageable with the mouthpiece.

In an embodiment, the electronic cigarette includes two of the liquid injection openings with center symmetry, and the abutting member forms two of the liquid injection channels corresponding to the two liquid injection openings respectively.

When e-liquid is injected to the electronic cigarette from the e-liquid bottle, the e-liquid bottle presses the liquid injection device to open the liquid injection opening, the second operation portion presses the control switch to open the liquid outlet, thus, the e-liquid bottle communicates with the liquid reservoir and e-liquid is injected into the liquid reservoir; after the e-liquid bottle is removed from the electronic cigarette, the liquid injection opening and the liquid outlet are closed, thus, e-liquid can be prevented from flowing out of the electronic cigarette to ensure the safety of the liquid injection operation.

BRIEF DESCRIPTION OF THE DRAWINGS

The present disclosure will be described in more detail with reference to the accompany drawings and the embodiments, wherein in the drawings.

PREFERRED EMBODIMENTS

For clearly understanding technical features, purpose, and effect of the present disclosure, embodiments are given in detail hereinafter with reference to the accompanying drawings.

Figure 1:
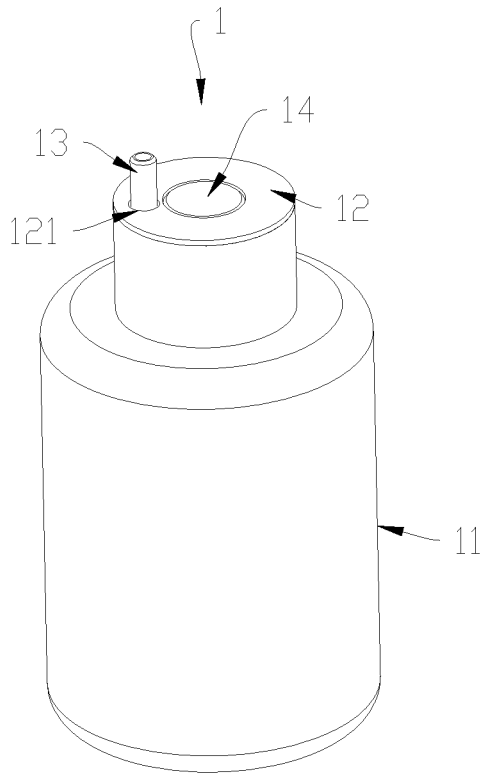
FIG. 1 is a perspective view of an e-liquid bottle in accordance with an embodiment of the present disclosure.
Figure 2:
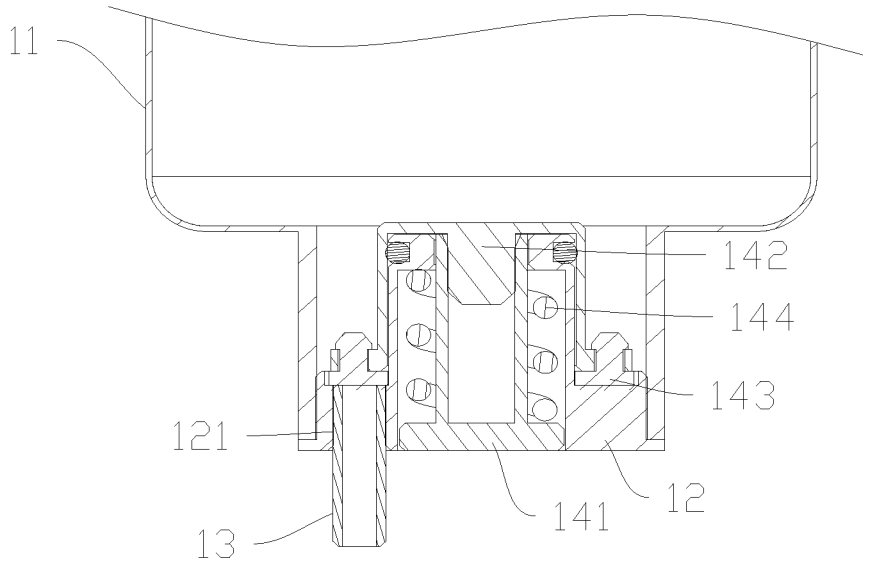
FIG. 2 is a cross-sectional view of the e-liquid bottle of FIG. 1 in accordance with an embodiment of the present disclosure.
Figure 3:
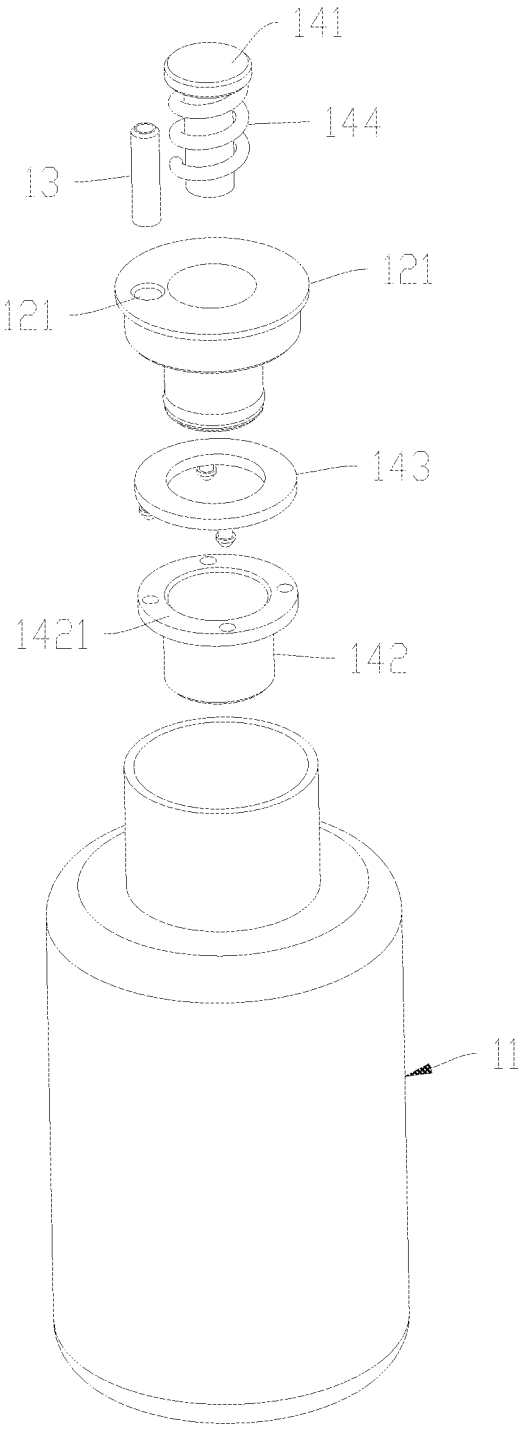
FIG. 3 is an exploded view of the e-liquid bottle of FIG. 1 in accordance with an embodiment of the present disclosure.

Referring to FIGS. 1 to 3, an e-liquid bottle 1 in accordance with an embodiment includes a main body 11, a cover 12, a liquid-out tube 13, and a control switch 14. A liquid outlet 121 is formed in the cover 12, positioned separately from the switch 14; and the liquid-out tube 13 is inserted in the liquid outlet 121 and extends outwards from the liquid outlet 121, thereby facilitating liquid injection to the electronic cigarette. It is understood that the e-liquid bottle 1 can include one or more liquid-out tubes 13, and in some embodiments, the liquid-out tube 13 can be integrated with the cover 12. The cover 12 forms a first operation portion for abutting a liquid injection device 23 of the electronic cigarette such that e-liquid can be injected to the electronic cigarette. During the injection of e-liquid, the cover 12 abuts the liquid injection device 23 to open a liquid injection opening 2231, thus, e-liquid can be injected to the electronic cigarette through the liquid-out tube 13. In other embodiments, the first operation portion can be the main body 11 itself or other fixing components.

The control switch 14 is arranged on the cover 12 for controlling opening and closing of the liquid outlet 121. When the control switch 14 is pressed inwards, the liquid outlet 121 is opened, thus e-liquid can be injected into the electronic cigarette; when the control switch 14 is released, the liquid outlet 121 is closed and thus the liquid injection is stopped.

In some embodiments, the control switch 14 includes a button switch 141, a supporting member 142, a liquid stopper 143, and a first restoring member 144. The button switch 141 is movably arranged on the cover 12, and the supporting member 142 is connected to an inner side of the button switch 141. In some embodiments, the supporting member 142 can be integrated with the button switch 141. The supporting member 142 includes a supporting board 1421 for holding the liquid stopper 143. The supporting board 1421 is annular and defines a fixing hole for receiving the liquid stopper 143.

In some embodiments, the liquid stopper 143 can be a gasket located at an inner side of the cover 12. The gasket is also annular, corresponding to the supporting board 1421.

A fixing column is arranged on the gasket and is inserted into the fixing hole defined in the supporting board 1421. The liquid stopper 143 is connected to the button switch 141 for sealing an inner end of the liquid outlet 121. The first restoring member 144 provides a force to the button switch 141 and the liquid stopper 143, thus the button switch 141 can restore to its original position and the liquid stopper 143 can seal the liquid outlet 121.

In some embodiments, the control switch 14 can be integrally formed and can be deformed inwards when being pressed to open the liquid outlet 121. In other embodiments, the control switch 14 can be an inductive switch capable of opening the liquid outlet 121 when being pressed.

Figure 4:
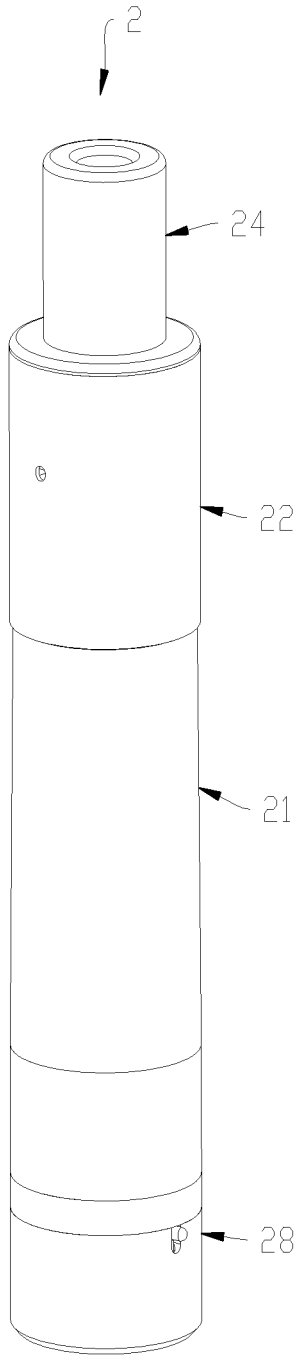
FIG. 4 is a perspective view of an atomizer of an electronic cigarette in accordance with an embodiment of the present disclosure.
Figure 5:
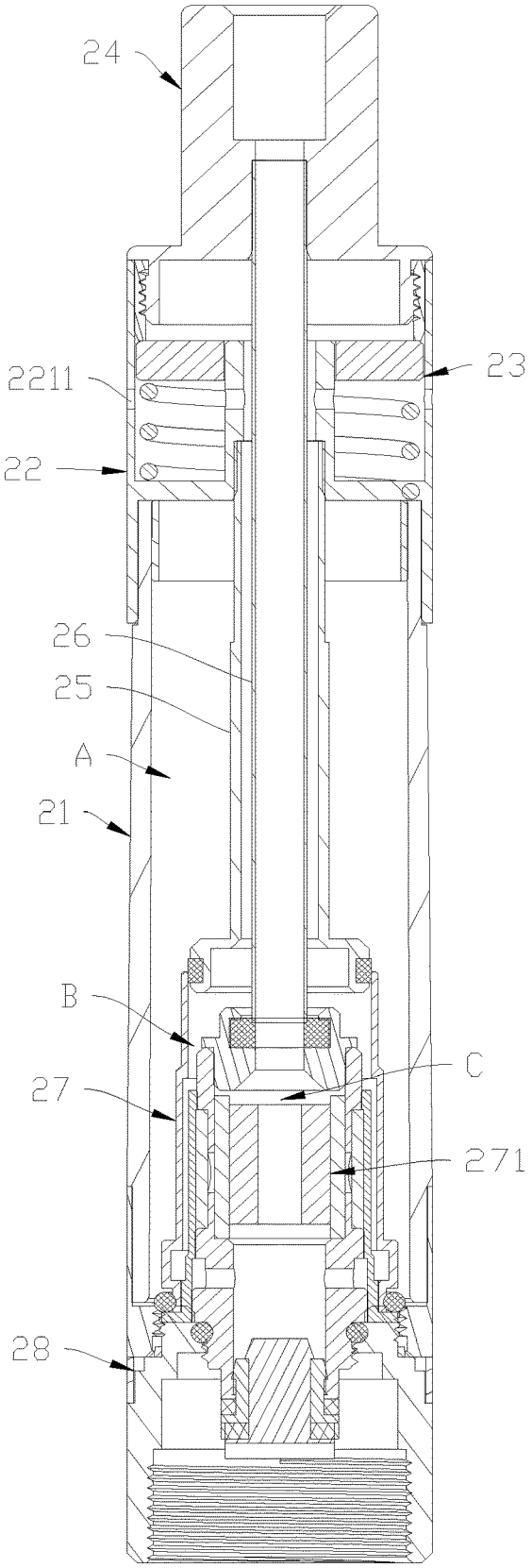
FIG. 5 is a cross-sectional view of the atomizer of FIG. 4 in accordance with an embodiment of the present disclosure.

As shown in FIGS. 4 and 5, the electronic cigarette engageable with the e-liquid bottle includes an atomizer 2 and a power supply. The atomizer 2 includes a cartridge 21, a connection member 22, the liquid injection device 23, a mouthpiece 24, an air tube 25, a smoke tube 26, an atomization assembly 27, and a base 28.

Figure 6:
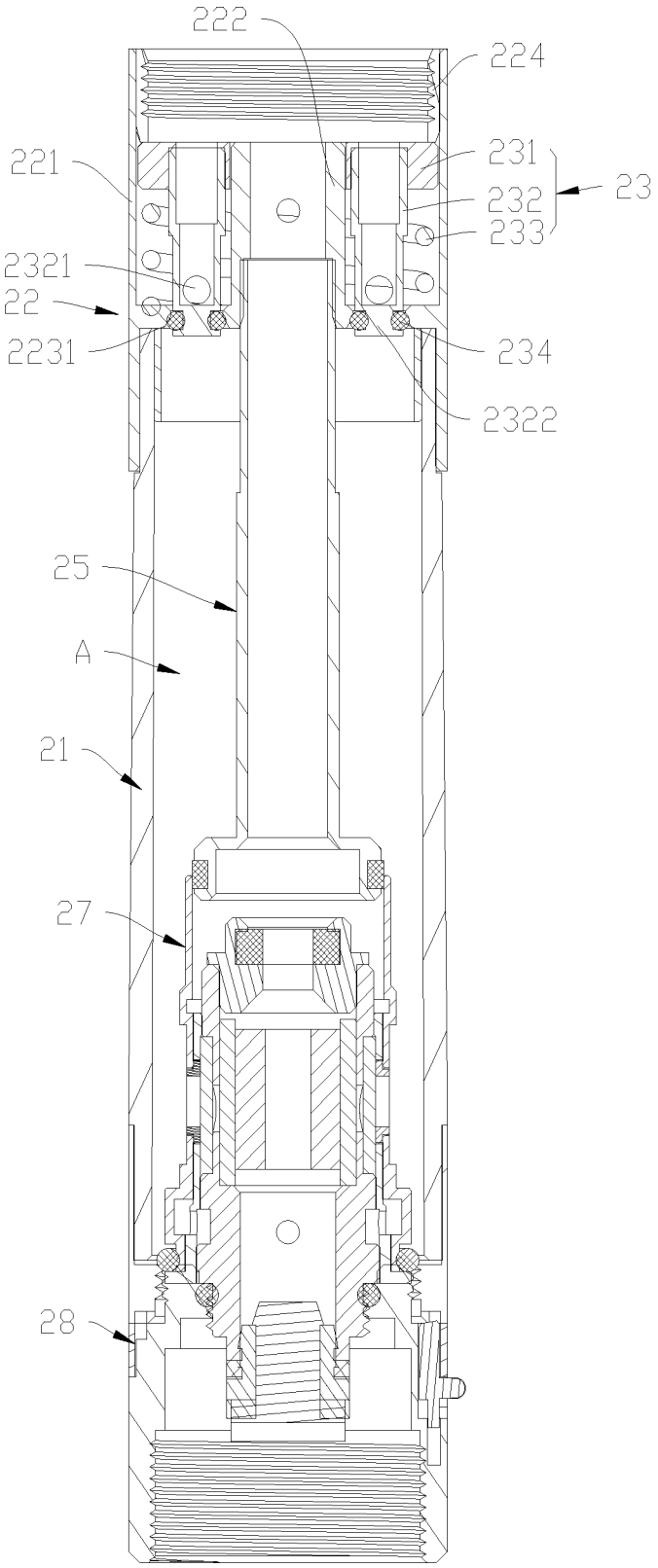
FIG. 6 is a cross-sectional view of the atomizer of FIG. 4 viewed from another angle with a mouthpiece and a smoke tube detached therefrom in accordance with an embodiment of the present disclosure.
Figure 7:
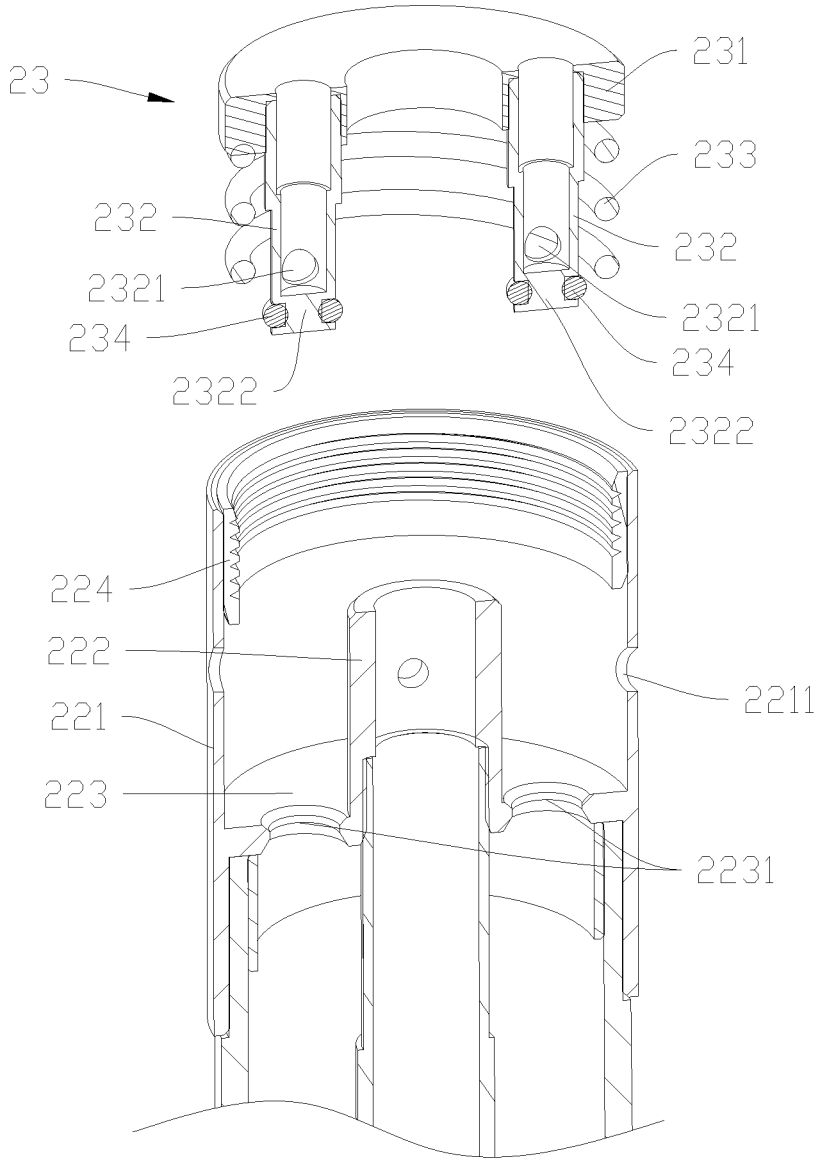
FIG. 7 is an exploded view of a liquid injection device and a cartridge of FIG. 6 in accordance with an embodiment of the present disclosure.
Figure 8:
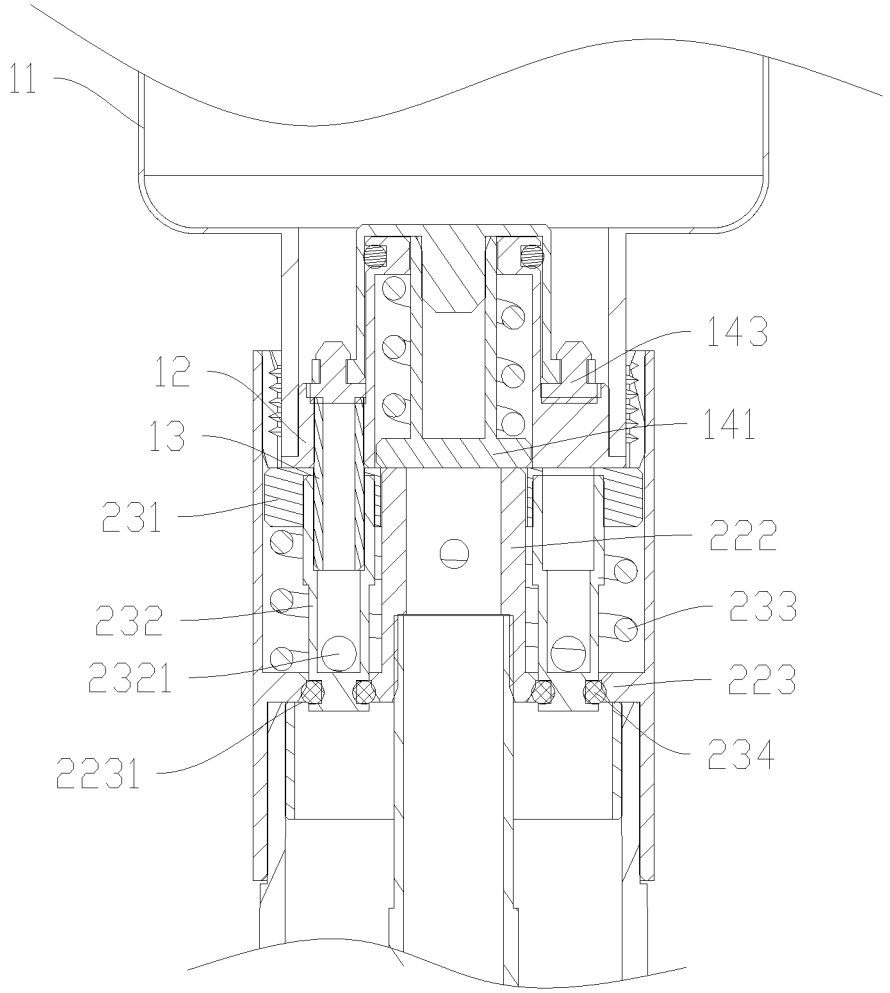
FIG. 8 is a cross-sectional view showing the engagement between the e-liquid bottle of FIG. 1 and the atomizer of FIG. 6 before the e-liquid is injected to the atomizer in accordance with an embodiment of the present disclosure.
Figure 9:
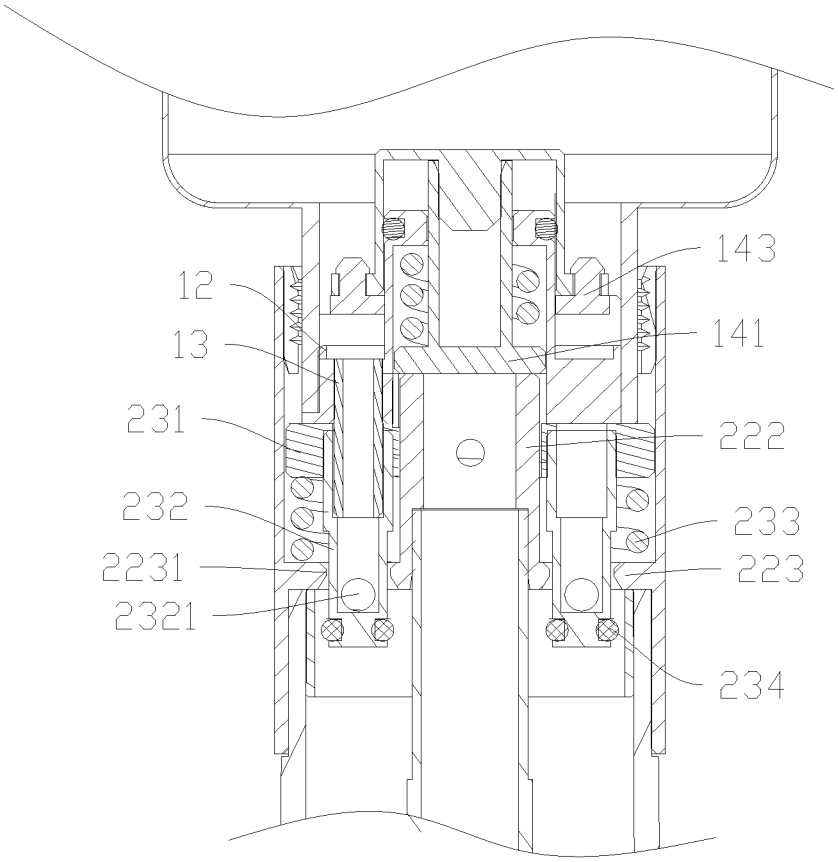
FIG. 9 is a cross-sectional view showing the state that the e-liquid bottle of FIG. 8 is pressed inwards to inject the e-liquid in accordance with an embodiment of the present disclosure.

As shown in FIGS. 6 and 7, the connection member 22 and the base 28 are respectively arranged on opposite ends of the cartridge 21. The atomization assembly 27 is mounted on the base 28. The air tube 25 penetrates through the cartridge 21, with two ends thereof respectively engaging with the atomization assembly 27 and the connection member 22. A liquid reservoir A is formed between the cartridge 21 and the air tube 25.

In some embodiments, the connection member 22 includes an annular plate, an outer tube 221 formed on an outer ring of the annular plate, and an inner tube formed on an inner ring of the annular plate. The annular plate forms an end wall 223 covering on end of the liquid reservoir A. Two liquid injection openings 2231 are formed in the annular plate and thus e-liquid can be injected into the liquid reservoir A. The liquid injection openings 2231 correspond to the liquid outlet 121 formed in the e-liquid bottle 1. In some embodiments, the two liquid injection openings 2231 are symmetrical about a center of the annular plate. In other embodiments, on the basis that the liquid injection opening 2231 can match the e-liquid bottle 1 to allow for liquid injection, the number of the liquid injection opening 2231 can be one or more than two.

The outer tube 221 includes a sleeving portion extending away from the liquid reservoir A. A connection portion 224 is arranged on an inner circle of one end of the sleeving portion away from the end wall 223. An inner circle of the connection portion 224 is configured with threads engageable with the mouthpiece 24. A first air inlet 2211 is formed in the sleeving portion such that air can enter the air tube 25 through the first air inlet 2211. In other embodiments, the first air inlet 2211 can be formed in the mouthpiece 24.

The smoke tube 26 is arranged inside the air tube 25 with one end thereof communicating with the air outlet 241 of the mouthpiece 24 and the other end thereof engaging with the atomization assembly 27. In assembly, the smoke tube 26 is at first connected to the mouthpiece 24 and then inserted into the air tube 25, and the mouthpiece 24 engages with the threads formed in the inner side of the connection portion 224. In disassembly, after the mouthpiece 24 is detached, the smoke tube 26 can be removed, thus, the disassembly of the smoke tube 26 is simple.

The inner tube protrudes outwards axially from the end wall 223 to form a second operation portion 222 for pressing the button switch 141 of the e-liquid bottle 1. The liquid injection openings 2231 are positioned separately from the second operation portion 222. The second operation portion 222 is located on an axis of the cartridge 21 for facilitating the positioning of the liquid injection device 23. The second operation portion 222 corresponds to the button switch 141 of the e-liquid bottle 1 for pressing the button switch 141. The second operation portion 222 can engage with the connection member 22 normally during the rotation of the e-liquid bottle 1. The smoke tube 26 is formed inside the air tube 25 and the inner tube with two ends thereof respectively engaging with the mouthpiece 24 and the atomization assembly 27. The smoke tube 26 is spaced from the inner tube for facilitating air to enter the air tube 25.

In some embodiments, on the basis that the second operation portion 222 can press the button switch 141, the second operation portion 222 can be a column or vertical wall extending outwards axially from the end wall 223, etc. In other embodiments, the connection member 22 can include the end wall 223 and the second operation portion 222, or the end wall 223 and the second operation portion 222 can be integrated with the cartridge 21.

Referring to FIGS. 6 to 9, the liquid injection device 23 is arranged on the end wall 223 such that the liquid injection device 23 can be pressed by the cover 12. The liquid injection device 23 includes an abutting member 231 for being pressed inwards by the cover 12, two liquid injection tubes 232 arranged on the abutting member 231, and a second restoring member 233 for keeping the abutting member 231 away from the end wall 223. The abutting member 231 is spaced from the end wall 223 and is capable of moving forwards and backwards relative to the end wall 223. In some embodiments, the abutting member 231 is annular and is sleeved on the inner tube. The abutting member 231 abuts an inner end of the connection member 224 to prevent the abutting member 231 from getting away from the sleeving portion.

The abutting member 231 defines two insertion holes. The two liquid injection tubes 232 are respectively inserted into the two insertion holes to form two liquid injection channels. The liquid injection tubes extend into the liquid injection openings 2231 respectively. With the two liquid injection tubes 232, the abutting member 231 and the liquid injection tubes 232 bear balanced forces when moving towards the liquid reservoir A, thereby avoiding jamming of the abutting member 231 and the liquid injection tubes 232. In other embodiments, the electronic cigarette can include only one liquid injection tube 232 arranged in the abutting member 231 and corresponding to the liquid-out tube 13.

A first liquid inlet 2321 is formed in each of the liquid injection tubes 232. In some embodiments, an outer wall of the liquid injection tube 232 tightly engages with the corresponding liquid injection opening 2231 to prevent leakage of e-liquid from the outer wall of the liquid injection tube 232. A blocker 2322 is arranged in an inner hole of the liquid injection tube 232 to block the liquid reservoir A from the first liquid inlet 2321; before e-liquid is injected into the liquid reservoir A, the blocker 2322 prevents leakage of e-liquid from the first liquid inlet 2321. In some embodiments, a sealing ring 234 is arranged between an outer wall of an inner end of the liquid injection tube 232 and the liquid injection opening 2231 to seal the liquid injection opening 2231 and thus avoid the leakage of e-liquid. In other embodiments, the liquid injection tube 232 can be made of flexible material such that the sealing effect between the liquid injection tube 232 and the liquid injection opening 2231 can be improved due to the property of the flexible material.

In some embodiments, the liquid injection tube 232 is a stepped tube including a first section and a second section. A diameter of the first section is greater than that of the second section. The first section is inserted into the abutting member 231 and the second section is inserted into the liquid injection opening 2231. A slot is formed in an outer ring of the second section in which the sealing ring 234 is mounted, thereby preventing the sealing ring 234 from dropping off. A step is formed on an outer wall of the first section at the connection between the first section and that of the second section, thereby restricting the movement of the liquid injection tube 232 inside the liquid injection opening 2231. An inner hole of the first section corresponds to the liquid-out tube 13, such that the liquid-out tube 13 can be inserted into the inner hole of the first section to avoid the leakage of e-liquid. An inner hole of the second section is smaller than that of the first section to form the step which restricts an insertion depth of the liquid-out tube 13 into the liquid injection tube 232. In other embodiments, protrusions may be arranged on an outer wall and an inner wall of the liquid injection tube 232 to respectively restrict the insertion depth of the liquid injection tube 232 into the liquid injection opening 2231 and the liquid injection opening 232.

The second restoring member 233 is located between the abutting member 231 and the end wall 223 for providing a force which is capable of keeping the abutting member 231 away from the end wall 223 and thus keeping the first liquid inlet 2321 out of the end wall 223. In some embodiments, the second restoring member 233 may be a spring or an elastic piece located between the end wall 223 and the abutting member 231.

When the liquid injection device 23 is pressed inwards by the cover 12, the liquid injection tube 232 moves inwards to communicate the liquid injection opening 2231 with the liquid reservoir A; meanwhile, the second operation portion 222 presses the button switch 141 to communicate the liquid outlet 121 with the liquid injection channel, thus the e-liquid can be injected into the liquid reservoir A from the e-liquid bottle 1. When the e-liquid bottle 1 is removed, the liquid injection channel restores outwards to its original position, thereby blocking the first liquid inlet 2321 from the liquid reservoir A. In some embodiments, the liquid injection tube 232 can be integrated with the abutting member 231, thus, when the cover 12 presses the abutting member 231, the liquid injection tube 232 moves correspondingly.

In some embodiments, the liquid injection opening 2231 may be configured with an elastic sealing member and the liquid injection tube 232 may be located out of the liquid injection opening 2231; when the abutting member 231 is pressed by the liquid injection tube 232, the liquid injection tube 232 pushes the elastic sealing member off to open the liquid injection opening, thereby communicating the liquid injection opening 2231 with the liquid reservoir A; when the e-liquid bottle 1 is removed, the abutting member 231 and the liquid injection tube 232 restores outwards to their original positions, thus, the elastic sealing member automatically closes the liquid injection opening 2231.

In some embodiments, the second restoring member 233 may be omitted, the abutting member 231 may be a compressed spring or elastic piece, and the liquid injection tube 232 is arranged on the abutting member 231; when the abutting member 231 is compressed by the cover 12, the liquid injection tube 232 moves inwards to communicate the liquid injection opening 2231 with the liquid reservoir A; when the e-liquid bottle 1 is removed, the abutting member 231 restores to its original shape to drive the liquid injection tube 232 to move outwards, thereby blocking the first liquid inlet 2321 from the liquid reservoir A.

Figure 10:
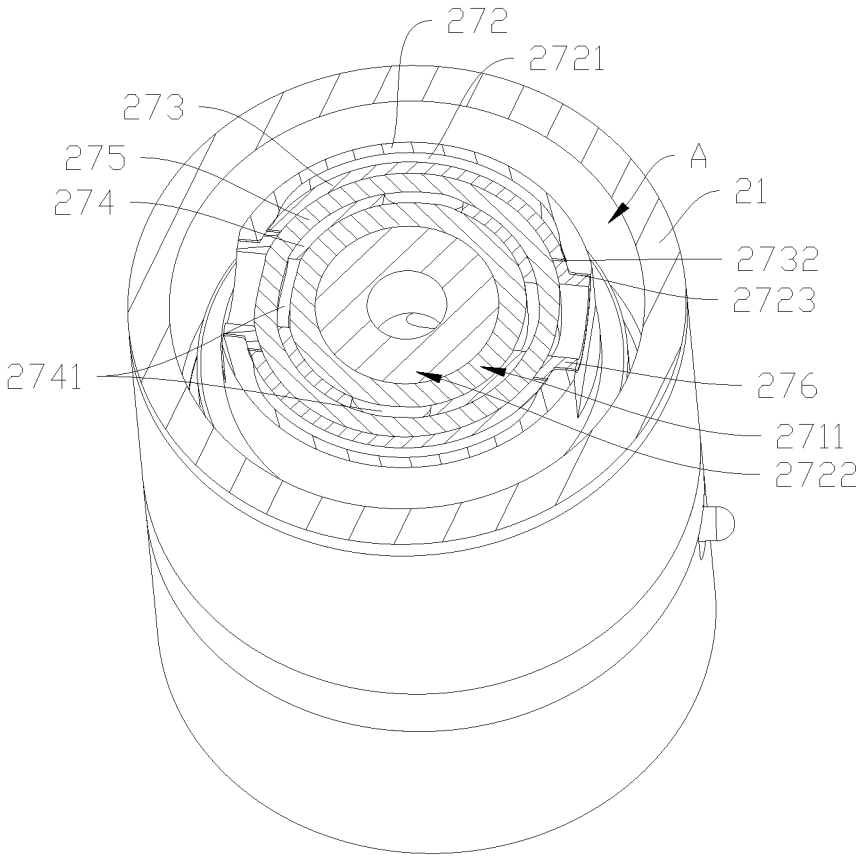
FIG. 10 is a lateral cross-sectional view of the atomizer of FIG. 4 taken from an atomization assembly in accordance with an embodiment of the present disclosure.

Referring to FIGS. 5 and 10, in some embodiments, the first air inlet 2211 formed in the outer tube 221 of the connection member 22 communicates with the inner tube and the air tube 25. The air tube 25 forms an air-in channel such that air can flow to the atomization assembly 27. The smoke tube 26 forms an air-out channel. The atomization assembly 27 is located at the connection between the air-in channel and the air-out channel, and thus atomized smoke from the atomization assembly 27 can flow into the mouthpiece 24 with airflows inside the air-in channel and the air-out channel Since the air tube 25 is sleeved on the smoke tube 26, cool air inside the air tube 25 can cool heated smoke inside the smoke tube 26, allowing a user to have a comfortable smoke inhalation. In other embodiments, the air-out channel also can be located outside the air-in channel or adjacent to the air-in channel. In some embodiments which cooling of smoke is not required, the air-in channel and the air-out channel can be arranged in other ways.

Figure 11:
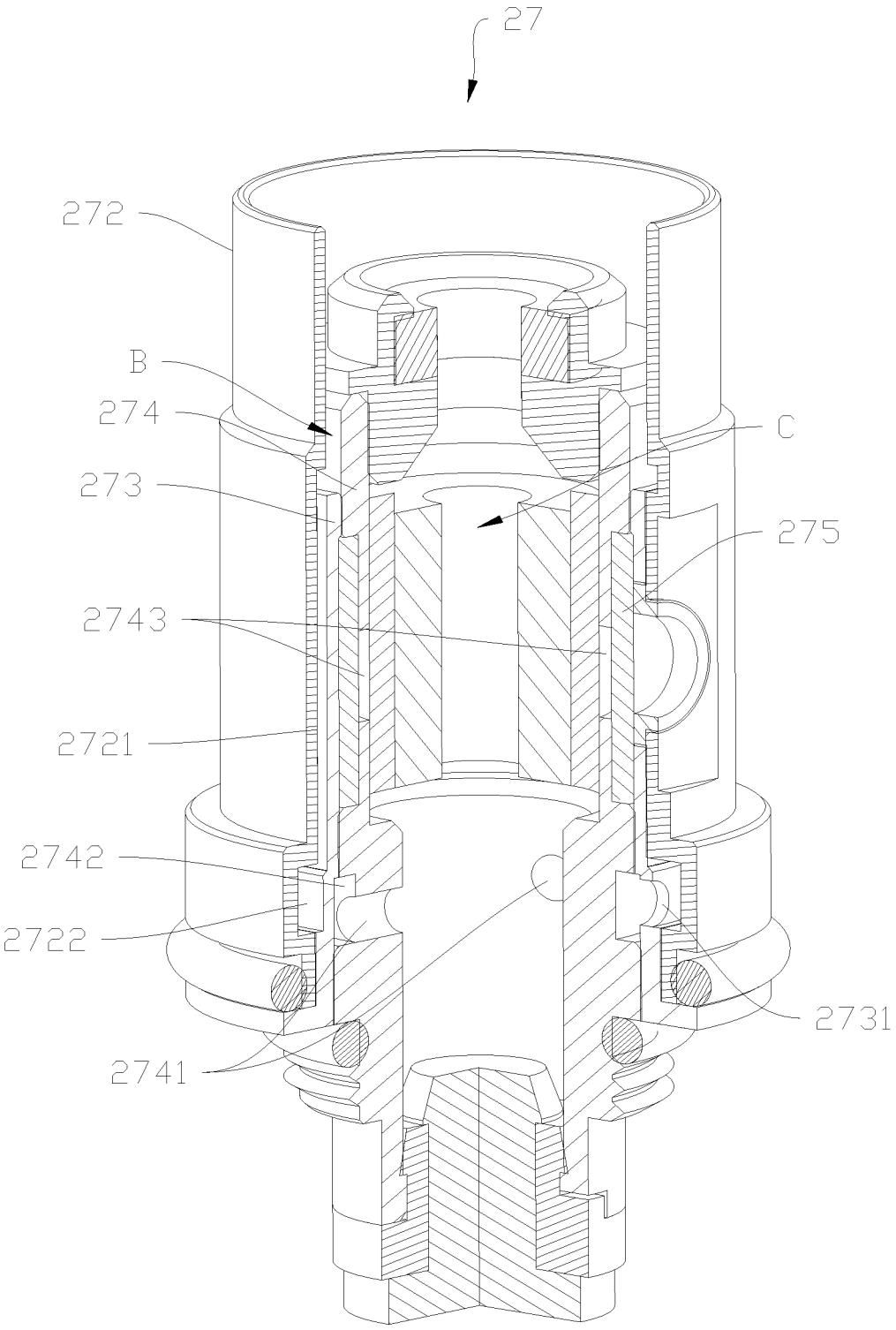
FIG. 11 is a cross-sectional view of the atomization assembly of FIG. 5 in accordance with an embodiment of the present disclosure.
Figure 12:
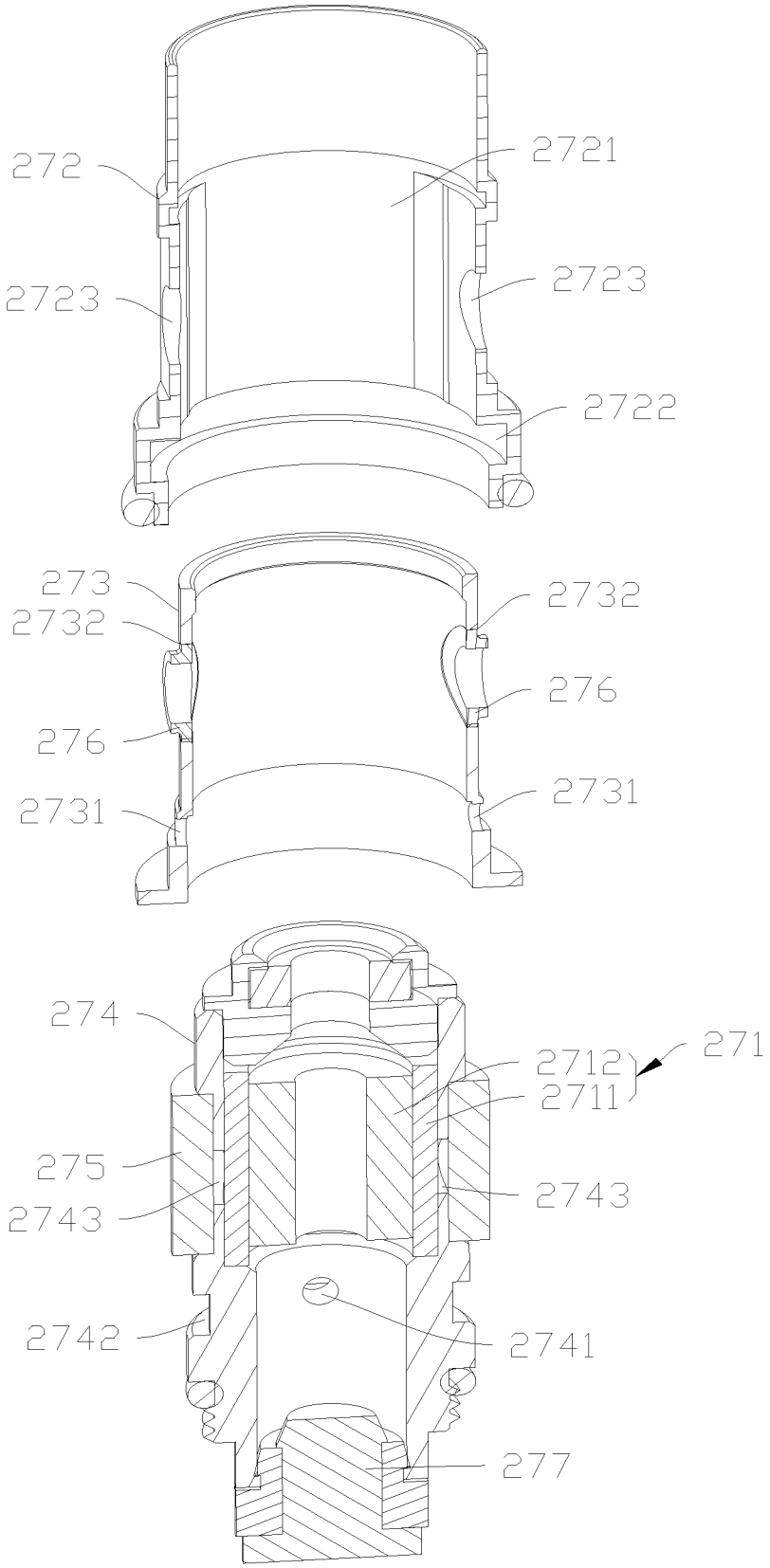
FIG. 12 is an exploded view of the atomization assembly of FIG. 5 in accordance with an embodiment of the present disclosure.

As shown in FIGS. 10 to 12, the atomization assembly 27 defines an air-in space B communicating with the air-in channel and an air-out space C communicating with the air-out channel. The air-in space B communicates with the air-out space C. The atomization assembly 27 includes a heating assembly 271 arranged in the air-out space C for heating the e-liquid. After the e-liquid is atomized, the smoke flows into the mouthpiece 24 along the air-out channel with airflows.

In some embodiments, the air-in space B surrounds the air-out space C, which reduces the temperature of the atomization assembly 27 such that the heat of the atomization assembly 27 may not be conducted to the e-liquid in the liquid reservoir A. In other embodiments, the air-out space C may surround the air-in space B to expand the air-out space and thus facilitate heat radiation.

In some embodiments, the atomization assembly 27 includes an outer tube body 272, a dividing tube 273, an inner tube body 274, and a first liquid absorbing member 275. The dividing tube 273 is sleeved on the inner tube body 274, and the outer tube body 272 is sleeved on the dividing tube 273. The air-in space B is defined between the outer tube body 272 and the inner tube body 274, and the air-out space C is defined in the inner tube body 274.

One end of the outer tube body 272 communicates with the air-in channel, and one end of the inner tube body 274 communicates with the air-out channel. The dividing tube 273 forms a second air inlet 2731 which communicates with the air-in space B, and an outer wall of the inner tube body 274 forms a third air inlet 2741 which communicates the second air inlet 2731 with the air-out space C. Thus, the air-in space B, the second air inlet 2731, the third air inlet 2741, and the air-out space C communicate with each other to allow for air circulation.

In order to ensure the air circulation from the air-in space B to the second air inlet 2731, two recessed portions 2721 are formed in an inner wall of the outer tube body 272 along a circumferential direction of the outer tube body 272. The recessed portions 2721 communicate with the air-in channel to form an airflow channel between the outer tube body 272 and the dividing tube 273. Correspondingly, the dividing tube 273 forms two second air inlets 2731 corresponding to the two recessed portions 2721 respectively. In other embodiments, the number of the recessed portion 2721 may be one or more than two, and the recessed portion 2721 may be formed in an outer wall of the dividing tube 273, or, formed in both the inner wall of the outer tube body 272 and the outer wall of the dividing tube 273.

The second air inlet 2731 misaligns with the corresponding recessed portion 2721 circumferentially, which increases the path of the airflows and improves the heat radiation effect. In some embodiments, the third air inlet 2741 is formed in one end of the inner tube body 274 corresponding to the air-out channel, thus, the atomized smoke from the heating assembly 271 can enter the air-out channel through the third air inlet 2741. The second air inlet 2731 corresponds to the third air inlet 2741 axially.

A first airflow slot 2722 is formed between the outer tube body 272 and the dividing tube 273. The first airflow slot 2722 communicates the air-in space B with the second air inlet 2731. The second air inlet 2731 misaligns with the third air inlet 2741 circumferentially. A second airflow slot 2742 is formed between the inner tube body 274 and the dividing tube 273 for communicating with the second air inlet 2731 with the third air inlet 2741. The first airflow slot 2722 and the second airflow slot 2742 are arranged circumferentially such that air can circulate inside the atomization assembly 27. With the air circulation, the air can cool the atomization assembly 27 fully before entering the inner tube body 274.

In some embodiments, the outer tube body 272 forms a second liquid inlet 2723, the dividing tube 273 forms a third liquid inlet 2732, and the inner tube body 274 forms a fourth liquid inlet 2743. The second liquid inlet 2723 communicates with the third liquid inlet 2732, and the third liquid inlet 2732 communicates with the fourth liquid inlet 2743. The first liquid absorbing member 275 is arranged between the dividing tube 273 and the outer tube body 272 such that the e-liquid in the liquid reservoir A can flow into the heating assembly 271 through the second liquid inlet 2723, the third liquid inlet 2732 and the fourth liquid inlet 2743 to be heated and atomized.

The atomization assembly 27 further includes a sealing cover 276 penetrating through the second liquid inlet 2723 and the third liquid inlet 2732, which prevents the leakage of e-liquid from a gap between the outer tube body 272 and the diving tube 273. The recessed portion 2721 misaligns with the second liquid inlet 2723 circumferentially, thus, the second liquid inlet 2723 can be sealed from the third liquid inlet 2732 of the dividing tube 273.

In other embodiments, the dividing tube 273 and the first liquid absorbing member 275 can be omitted, and the outer tube body 272 is spaced from the inner tube body 274 to define the air-in space B. A tube or a liquid guider can be arranged between the second liquid inlet 2723 and the fourth liquid inlet 2743 for guiding the e-liquid to the heating assembly 271. The air-in space B can fully reduce the temperature of the outer wall of the inner tube body 274, thereby reducing the heat conducted to the liquid reservoir A.

Figure 13:
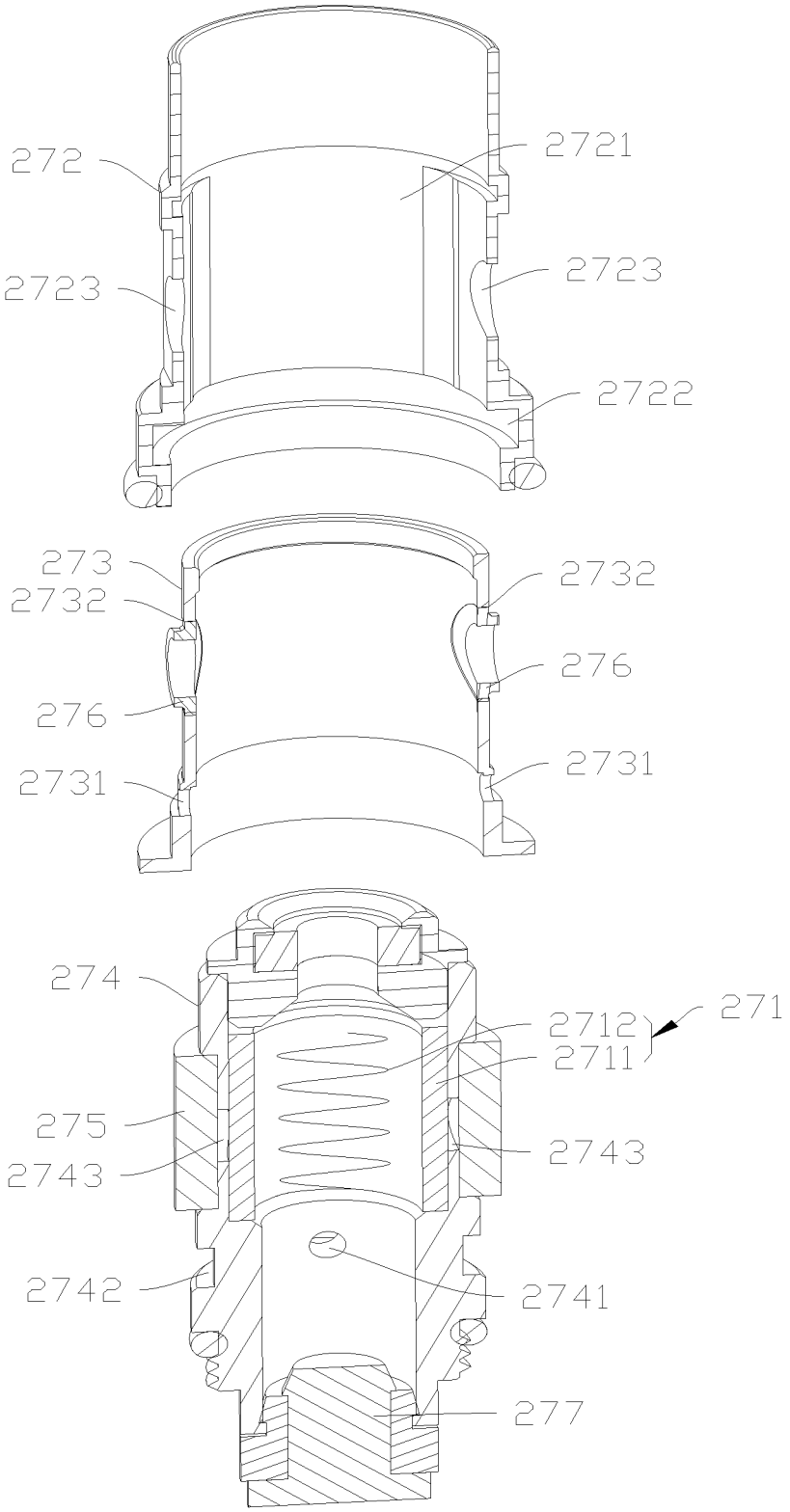
FIG. 13 is a schematic view of the atomization assembly in accordance with an embodiment of the present disclosure in which a heating element is a heating wire of FIG. 5.

In some embodiments, the heating assembly 271 includes a second liquid absorbing member 2711 and a heating element 2712. The second liquid absorbing member 2711 absorbs the e-liquid entering the fourth liquid inlet 2743 such that the e-liquid can be heated and atomized by the heating element 2712. The atomized smoke flows into the air-out channel with airflows. The heating element 2712 may be a ceramic heating element 2713. As shown in FIG. 13, the heating element 2712 also can be a heating wire. In other embodiments, the heating assembly 271 can only include the ceramic heating element 2713, and the e-liquid entering the fourth liquid inlet 2743 is absorbed by the ceramic heating element 2713 and then is heated and atomized by the ceramic heating element 2713.

In some embodiments, a plugging member 277 is arranged in one end of the inner tube body 274 corresponding to the smoke tube 26, thus, air is only allowed to enter the air-out space C through the air inlet space B to ensure the cooling effect of the atomization assembly 27.

The contents described above are only preferred embodiments of the present disclosure, but the scope of the present disclosure is not limited to the embodiments. Any ordinarily skilled in the art would make any modifications or replacements to the embodiments in the scope of the present disclosure, and these modifications or replacements should be included in the scope of the present disclosure. Thus, the scope of the present disclosure should be subjected to the claims.

What is claimed is:

1. An atomizer, comprising a cartridge (21) and a liquid injection device (23); wherein, a liquid reservoir (A) is defined in the cartridge (21), and the cartridge (21) comprises an end wall (223) which defines at least one liquid injection opening (2231);

the liquid injection device (23) is arranged on the end of the cartridge (21) corresponding to the end wall (223), the liquid injection device (23) defines at least one liquid injection channel extending in the at least one liquid injection opening (2231), and a first liquid inlet (2321) is defined in the liquid injection channel; and when the liquid injection device (23) is pressed inwards, the liquid injection channel moves inwards to communicate the first liquid inlet (2321) with the liquid reservoir (A); when the liquid injection device (23) is released, the liquid injection channel restores to its original position to block the first liquid inlet (2321) from the liquid reservoir (A).

2. The atomizer of claim 1, wherein the liquid injection device (23) comprises a liquid injection tube (232) extending in the liquid injection opening (2231), and the liquid injection tube (232) defines the liquid injection channel.

3. The atomizer of claim 2, wherein the first liquid inlet (2321) is defined in a side wall of the liquid injection tube (232).

4. The atomizer of claim 2, wherein an outer wall of the liquid injection tube (232) engages with the liquid injection opening (2231) tightly.

5. The atomizer of claim 2, wherein a blocker (2322) is arranged at an inner end of the liquid injection tube (232) to block the liquid reservoir (A) from the first liquid inlet (2321).

6. The atomizer of claim 2, wherein an inner end of the liquid injection tube (232) is enclosed.

7. The atomizer of claim 2, wherein a sealing ring (234) is arranged between an outer wall of an inner end of the liquid injection tube (232) and the liquid injection opening (2231).

8. The atomizer of claim 2, wherein the liquid injection device (23) further comprises a second restoring member (233) providing a force for the liquid injection tube (232) to move outwards to its original position.

9. The atomizer of claim 8, wherein the second restoring member (233) is sleeved outside the liquid injection tube (232).

10. An electronic cigarette, comprising a cartridge (21) and a liquid injection device (23); wherein, a liquid reservoir (A) is defined in the cartridge (21), and one end of the cartridge (21) comprises an end wall (223) which defines at least one liquid injection opening (2231);

the liquid injection device (23) is arranged on the end of the cartridge (21) corresponding to the end wall (223), the liquid injection device (23) defines at least one liquid injection channel extending in the at least one liquid injection opening (2231), and a first liquid inlet (2321) is defined in the liquid injection channel; and when the liquid injection device (23) is pressed inwards, the liquid injection channel moves inwards to communicate the first liquid inlet (2321) with the liquid reservoir (A); when the liquid injection device (23) is released, the liquid injection channel restores to its original position to block the first liquid inlet (2321) from the liquid reservoir (A).

11. The electronic cigarette of claim 10, wherein the liquid injection device (23) comprises a liquid injection tube (232) extending in the liquid injection opening (2231), and the liquid injection tube (232) defines the liquid injection channel.

12. The electronic cigarette of claim 11, wherein the first liquid inlet (2321) is defined in a side wall of the liquid injection tube (232).

13. The electronic cigarette of claim 11, wherein an outer wall of the liquid injection tube (232) engages with the liquid injection opening (2231) tightly.

14. The electronic cigarette of claim 11, wherein a blocker (2322) is arranged at an inner end of the liquid injection tube (232) to block the liquid reservoir (A) from the first liquid inlet (2321).

15. The electronic cigarette of claim 11, wherein an inner end of the liquid injection tube (232) is enclosed.

16. The electronic cigarette of claim 11, wherein a sealing ring (234) is arranged between an outer wall of an inner end of the liquid injection tube (232) and the liquid injection opening (2231).

17. The electronic cigarette of claim 11, wherein the liquid injection device (23) further comprises a second restoring member (233) providing a force for the liquid injection tube (232) to move outwards to its original position.

18. The electronic cigarette of claim 17, wherein the second restoring member (233) is sleeved outside the liquid injection tube (232).

* * * * *